US009879831B2

(12) United States Patent
Klafta et al.

(10) Patent No.: US 9,879,831 B2
(45) Date of Patent: Jan. 30, 2018

(54) SEMICONDUCTOR LAMP WITH TUBULAR CONTACT PINS

(71) Applicant: OSRAM GmbH, Munich (DE)

(72) Inventors: Thomas Klafta, Maxhutte-Haidhof (DE); Dietmar Schmidt, Giengen (DE)

(73) Assignee: LEDVANCE GmbH (DE)

( * ) Notice: Subject to any disclaimer, the term of this patent is extended or adjusted under 35 U.S.C. 154(b) by 0 days.

(21) Appl. No.: 15/448,229

(22) Filed: Mar. 2, 2017

(65) Prior Publication Data

US 2017/0254483 A1 Sep. 7, 2017

(30) Foreign Application Priority Data

Mar. 2, 2016 (DE) ..... 10 2016 203 405

(51) Int. Cl.

| | |
|---|---|
| ***H01R 13/04*** | (2006.01) |
| ***F21K 9/235*** | (2016.01) |
| ***F21K 9/233*** | (2016.01) |
| ***F21K 9/238*** | (2016.01) |
| ***H01R 12/58*** | (2011.01) |
| ***H01R 13/42*** | (2006.01) |
| ***H01R 33/06*** | (2006.01) |

(52) U.S. Cl.

CPC ..... *F21K 9/235* (2016.08); *F21K 9/233* (2016.08); *F21K 9/238* (2016.08); *H01R 12/58* (2013.01); *H01R 13/04* (2013.01); *H01R 13/42* (2013.01); *H01R 33/06* (2013.01)

(58) Field of Classification Search

CPC ..... H01R 33/08; H01R 24/28; H01R 13/28

USPC ..... 439/619, 692, 699.1; 326/294

See application file for complete search history.

(56) References Cited

U.S. PATENT DOCUMENTS

| | | | | |
|---|---|---|---|---|
| 2,680,236 A * | 6/1954 | Kuebler | H01J 5/50 | 439/612 |
| 4,102,558 A * | 7/1978 | Krachman | H01J 5/50 | 313/318.02 |
| 4,854,888 A * | 8/1989 | Cannon | H01J 5/62 | 313/318.02 |
| 4,855,634 A * | 8/1989 | Gagnon | H01K 1/46 | 313/113 |

(Continued)

FOREIGN PATENT DOCUMENTS

| | | |
|---|---|---|
| CN | 2805149 Y | 8/2006 |
| DE | 202007009060 U1 | 8/2008 |

(Continued)

*Primary Examiner* — Hae Moon Hyeon

(74) *Attorney, Agent, or Firm* — Hayes Soloway PC

(57) ABSTRACT

A semiconductor lamp comprises a housing in which a driver is accommodated and at least one contact pin protruding from the housing outwards, wherein the contact pin is tubular and riveted to the housing and the driver is connected to the contact pin via an electrically conductive connection element which is inserted into a cavity of the contact pin. A method serves for producing a semiconductor lamp, wherein at least one tubular contact pin is inserted into a feedthrough of a housing from outside till the contact pin abuts the housing, the contact pin is next riveted with the housing on the inside and a driver is inserted into the housing, whereby an electrically conductive connection element is inserted into the contact pin. The invention is particularly applicable to LED retrofit lamps for replacing bipin halogen lamps, in particular MR16 lamps.

12 Claims, 4 Drawing Sheets

(56) References Cited

U.S. PATENT DOCUMENTS

| | | | | |
|---|---|---|---|---|
| 4,878,854 | A * | 11/1989 | Cannon | F21V 19/0085 313/318.02 |
| 4,912,371 | A * | 3/1990 | Hamilton | H05B 41/392 315/121 |
| 7,329,159 | B2 * | 2/2008 | Wilson | H01J 5/62 439/884 |
| 9,638,409 | B2 * | 5/2017 | Kuriyama | F21V 29/773 |
| 2011/0115372 | A1 | 5/2011 | Tokes et al. | |
| 2012/0147608 | A1 * | 6/2012 | Kawagoe | F21V 5/007 362/294 |
| 2012/0187836 | A1 | 7/2012 | Hashimoto et al. | |
| 2012/0268941 | A1 * | 10/2012 | Shih | F21V 3/02 362/294 |
| 2013/0230995 | A1 | 9/2013 | Ivey et al. | |
| 2015/0055354 | A1 * | 2/2015 | Mueller | F21K 9/23 362/373 |
| 2015/0323169 | A1 * | 11/2015 | Kuriyama | F21K 9/233 362/294 |

FOREIGN PATENT DOCUMENTS

| | | | |
|---|---|---|---|
| DE | 202014001680 | U1 | 4/2014 |
| EP | 3009740 | A1 | 4/2016 |
| WO | 2012114241 | A2 | 8/2012 |
| WO | 2014198182 | A1 | 12/2014 |

* cited by examiner

SEMICONDUCTOR LAMP WITH TUBULAR CONTACT PINS

FIELD OF THE DISCLOSURE

The invention relates to a semiconductor lamp comprising a housing in which a driver is accommodated and at least one contact pin protruding from the housing outwards. The invention is in particular applicable to LED retrofit lamps for replacing bipin halogen lamps, in particular MR16 lamps.

BACKGROUND

Hitherto, a light-emitting diode (LED) lamp is elaborately assembled from several elements in several process steps in a production line or manually. Conventional MR16 retrofit lamps have a GU5.3 compatible base which comprises two contact pins or simply "pins". An electronic driver 101, shown in FIG. 4A in an oblique view partially, of a conventional LED MR16 retrofit lamp 100 can be supplied with electrical energy through the contact pins 102 and converts it into operation signals for the LEDs (not shown). For this purpose, the driver 101 is equipped with and soldered to the contact pins 102. As shown in FIG. 4B in an oblique view partially, the driver 101 is plugged into a housing 103 during a final assembly of the LED MR16 retrofit lamp 100. In doing so, the contact pins 102 are guided from the inside through respective feedthroughs 104 out of the housing 103 such that they protrude from the housing 103 outwards. The contact pins 102 are fastened to the housing 103 in a form-fit manner without or only with a slight friction-fit. This fastening is not suited to avoid a force transmission to the driver 101 during the plug-in action of the LED MR16 retrofit lamp 100 into a socket, as an insertion force F acting on the contact pins 102 is directly transmitted to the driver 101 during the insertion of the LED MR16 retrofit lamp 100. To absorb the insertion force F before it further affects a housing cover, a cooling element, a light source module, optics and/or still other elements (not shown) through the driver 101 and might destroy the LED MR16 retrofit lamp 100, hitherto expensive and highly precise construction solutions for fastening or additional manufacturing steps are necessary.

Thus, in a known version the driver can be "potted" in the lamp; however, a not negligible possibility remains that the driver can still be pushed out. Further disadvantages are that an additional time-consuming production step for filling the ("potting") mass is necessary, waiting periods for curing the potting mass of up to eight hours are required, a weight of the lamp is increased, a lifetime of the connection of the potting mass to the housing is unknown, additional costs for the potting mass have to be considered and problems concerning the tightness of the feedthroughs during potting the lamp can occur.

In another known version an adhesive can be filled into the housing to secure the contact pins against being pushed out during inserting the LED lamp into the socket. For this purpose, an additional station in the production line is disadvantageously required. Also, a substantial time requirement for curing the adhesive is needed. Moreover, problems concerning the tightness of the feedthrough can occur also with gluing the LED lamp.

In still another known version a circuit board equipped with the LEDs can be screwed to the housing, which, however, can disadvantageously result in a tension on the driver, in particular on its driver circuit board. Additional costs for the screws also arise. Furthermore, problems with a glass bulb can result.

SUMMARY

The object of the present invention is to overcome the disadvantages of prior art at least partially.

This object is solved according to the features of the independent claims. Preferred embodiments can in particular be learned from the dependent claims.

The object is solved by a semiconductor lamp comprising a housing in which a driver is accommodated and at least one contact pin protruding from the housing outwards, wherein the contact pin is a tubular contact pin riveted to the housing and the driver is connected to the contact pin via an electrically conductive connection element which is inserted into a cavity of the contact pin.

By riveting, the contact pin is firmly connected to the housing and cannot, or only very hard, be pushed into the semiconductor lamp. The insertion force is rather diverted to the housing via the at least one contact pin. No additional constructive measures like snapping, screwing, potting or knurling are necessary anymore to avoid a force transmission to the driver.

The contact pin can comprise a hollow cylindrical portion arranged outside the housing. In comparison thereto, a portion inserted into the housing can laterally be widened. For an easy insertion into the housing and a secure fit in the housing it is an advantageous embodiment that the portion inserted into the housing has a cylindrical outer contour. This contour may have a circular cross-sectional shape for an especially easy insertion into the housing. However, the outer contour does not have to be circular, e.g. if twist-locking of the contact pin around its longitudinal axis shall be achieved, but may comprise a rectangular, an oval etc. cross-sectional shape, for example.

For example, the contact pin may consist of copper, aluminium or an alloy thereof, e.g. bronze.

The cavity can be formed in a cylindrical shape e.g. according to the type of an elongated hole. The contact pin or its cavity is open particularly at a side facing the driver. It can be open or closed at an outer side facing away from the driver. If the cavity is open at both sides, it may also be designated as a continuous elongated hole. If the cavity is open at one side only, it may also be referred to as a blind hole open at the driver side.

Furthermore, the semiconductor lamp comprises at least one semiconductor light source which is electrically connected to the driver. The at least one semiconductor light source can be mounted on a circuit board which, together, may be called a light source module or light engine. The circuit board can rest on or be thermally connected to a heat sink.

In a further embodiment the at least one semiconductor light source includes or has at least one light-emitting diode. If several light-emitting diodes are present, these can emit light of the same color or of different colors. A color can be monochrome (e.g. red, green, blue, etc.) or multichrome (e.g. white). The light emitted by the at least one light-emitting diode can also be an infrared light (IR-LED) or an ultraviolet light (UV-LED). Several light-emitting diodes can produce a mixed light; e.g. a white mixed light. The at least one light-emitting diode can contain at least one wavelength-transforming luminescent material (conversion LED). The luminescent material can alternatively or additionally be arranged remote from the light-emitting diode ("remote phosphor"). The at least one light-emitting diode can be provided in form of at least one, individually housed light-emitting diode or in form of at least one LED chip. Several LED chips can be mounted on a common substrate ("submount"). The at least one light-emitting diode can be equipped with at least one inherent and/or common optics for beam guidance, e.g. at least one Fresnel lens, collimator and so on. Instead of or additionally to inorganic light-emitting diodes, e.g. based on InGaN or AlInGaP, organic LEDs (OLEDs, e.g. polymer OLEDs) are also usable in general. Alternatively, the at least one semiconductor light source can comprise e.g. at least one diode laser.

In a configuration the contact pin has a laterally protruding projection resting on the housing from the outside. Thus, the insertion force exerted on the contact pin can be diverted to the housing in a particularly simple and reliable manner. The projection can also serve as a stop for precisely positioning the contact pin in relation to its penetration depth in the housing.

In a further embodiment the projection is formed as a circumferential flange. This results in the advantage that the force introduction into the housing can occur in an especially uniform and therefore also reliable manner.

The laterally protruding projection can be arranged at the widened region of the contact pin, in particular directly before a transition to the contact region.

In yet another configuration the cavity of the contact pin is funnel-shaped at driver side. Thus, inserting the electrically conductive connection element into the cavity is facilitated. For this purpose, the cavity is widening inwards.

In another configuration the electrically conductive connection element is a wire (without limiting the generality referred to as "contact wire" below). This results in the advantage that the connection element can be inserted into the contact pin in an especially easy way. Such a connection element is also particularly inexpensive.

The connection element can simply be inserted into the cavity in a further development. In a configuration which is especially reliable and comprises a small electrical transition resistance, the electrically conductive connection element is fastened on the contact pin. For this purpose, the connection element can be clamped, soldered, welded and/or crimped to the contact pin. A crimping can be provided in an especially simple way.

In a further configuration, the contact pin, at its contact portion arranged outside the housing, has at least one hole laterally leading to the cavity. The hole can be a continuous hole or a blind hole. A continuous hole, in particular, facilitates soldering and/or welding the connection element, in particular the contact wire, to the contact pin. The at least one hole can also simplify crimping.

In a further configuration the housing has a feedthrough provided for the respective contact pin and the feedthrough is widened at an inside portion. Due to the widening, space for at least a part of the material volume, laterally displaced by the riveting, of the contact pin (e.g. in form a collar formed by the riveting) is provided. This enables an especially compact structure and reduces a mechanical load on the housing around the contact pin. While a space exists between the widened portion of the feedthrough and the contact pin prior to the riveting, this space can at least partially be filled with the reshaped material of the contact pin after the riveting.

It is also a configuration that the semiconductor lamp has a pin base for halogen lamps ("bipin base"). This can particularly easily be implemented by means of the above-described contact pins.

Furthermore, it is a configuration that the semiconductor lamp is a MR16 replacement lamp or MR16 retrofit lamp. It can also be e.g. a PAR16 retrofit lamp or a MR11 retrofit lamp. The base may for example be a base of the type GU5.3 or GU4. The contact pin may in particular be a PAR16, MR16 or rather MR11 compatible contact pin.

The object is also solved by a method for producing a semiconductor lamp as described above wherein at least one tubular contact pin is inserted into a feedthrough of a housing in particular from outside till the contact pin abuts the housing, the contact pin is next riveted with the housing and a driver is inserted into the housing, whereby an electrically conductive connection element is inserted into the contact pin. The method can be implemented in analogue to the semiconductor lamp and results in the same advantages.

It is an embodiment that the connection element inserted into the contact pin is fastened on the contact pin.

The above-described characteristics, features and advantages of this invention as well as the way in which these will be achieved become more obvious and clearer in connection with the following schematic description of embodiments which will be explained in more details in connection with the drawings. Same elements or elements with the same effects may be provided with the same reference numbers for the sake of clarity.

DETAILED DESCRIPTION

Figure 1:
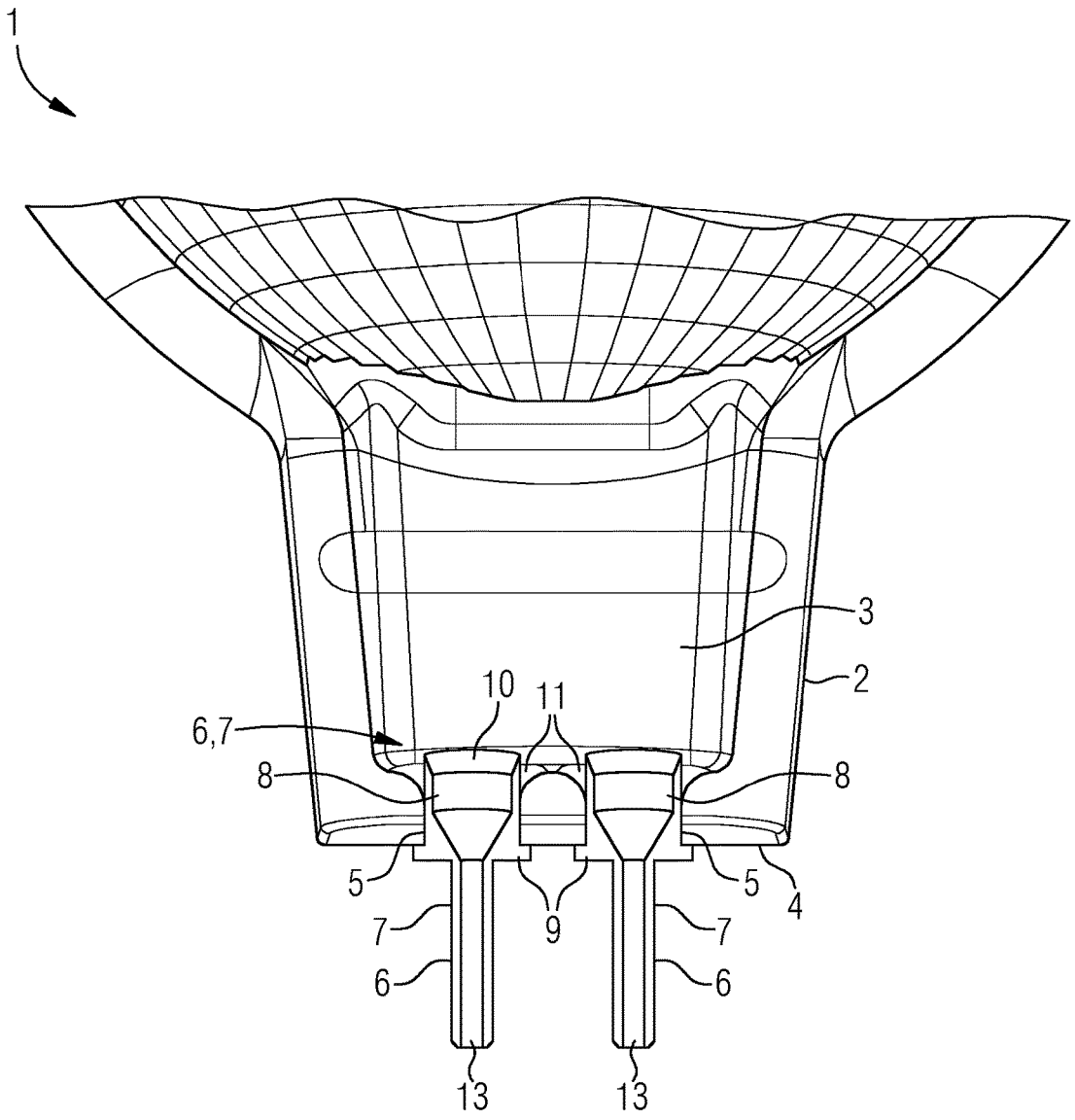
FIG. 1 shows a section of a retrofit lamp according to the invention in a cross-sectional side view.

FIG. 1 shows a section of a LED MR16 retrofit lamp 1 according to the invention in a cross-sectional side view. The retrofit lamp 1 comprises a housing 2 in which a driver 3 is accommodated. At a rear end face 4 of the housing 2 two feedthroughs 5 are provided into which respective contact pins 6 are inserted. The contact pins 6 have been inserted into the feedthroughs 5 from the outside and protrude from the housing 2 outwards. Hence, a bipin base is formed there.

The contact pins 6 have a tubular or pin-like basic shape. Namely, the contact portions 7 protruding outwards have a hollow cylindrical shape which is compatible with conventional MR16 contact pins 102. A widened portion 8 inserted into the feedthroughs 5 follows at the housing side. The widened portion 8 comprises a ring-shaped lateral projection or flange 9 at the transition to the contact portion 7. The flange 9 serves as a stop during inserting the respective contact pins 6 into the feedthroughs 5 and abuts the outside of the housing 2.

Afterwards, the contact pins 6 are riveted with the housing 2, for example by compressing the widened portions 8 in longitudinal direction. An inside or driver side edge 10 of the widened portion 8 can for example be reshaped such that it is pressed laterally outwards. In order to allow such a produced collar (not shown) to be particularly effectively supported against the housing 2, the feedthroughs 5 are widened at an inside portion 11 into which the displaced material of the respective contact pins 6 or the collar can at least partially spread. If the retrofit lamp 1 is inserted into a socket, the force thereby exerted on the contact pins 6 and acting towards the driver 3 is diverted to the housing 2. The flange 9 thus causes a form fit of the related contact pin 6 with the housing 2. The collar produced by the riveting at the inside portion 11 causes in an analogue manner that the contact pins 6 do not slide out of the housing 2 during unplugging the retrofit lamp 1 from the socket. The riveting furthermore causes a lateral pressing of the contact pin 6 against the housing 2 and therefore an additional press fit.

Figure 2A:
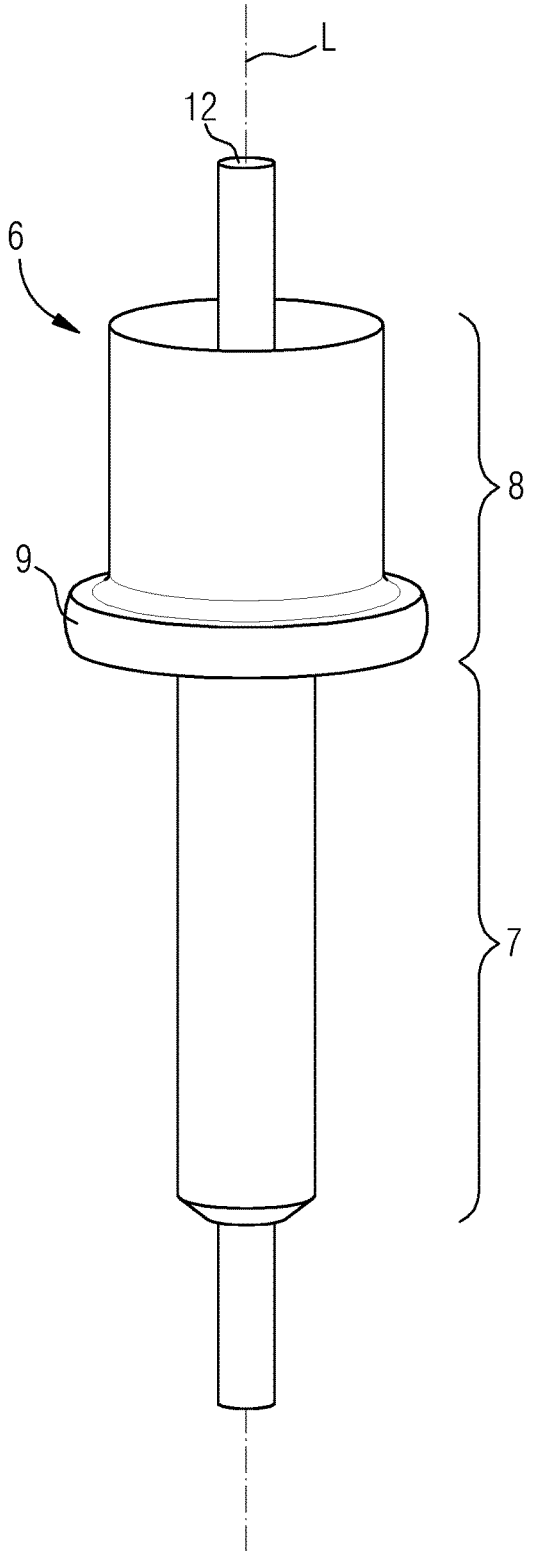
FIG. 2A shows a contact pin of the retrofit lamp according to the invention according to a first embodiment in an oblique view.
Figure 2B:
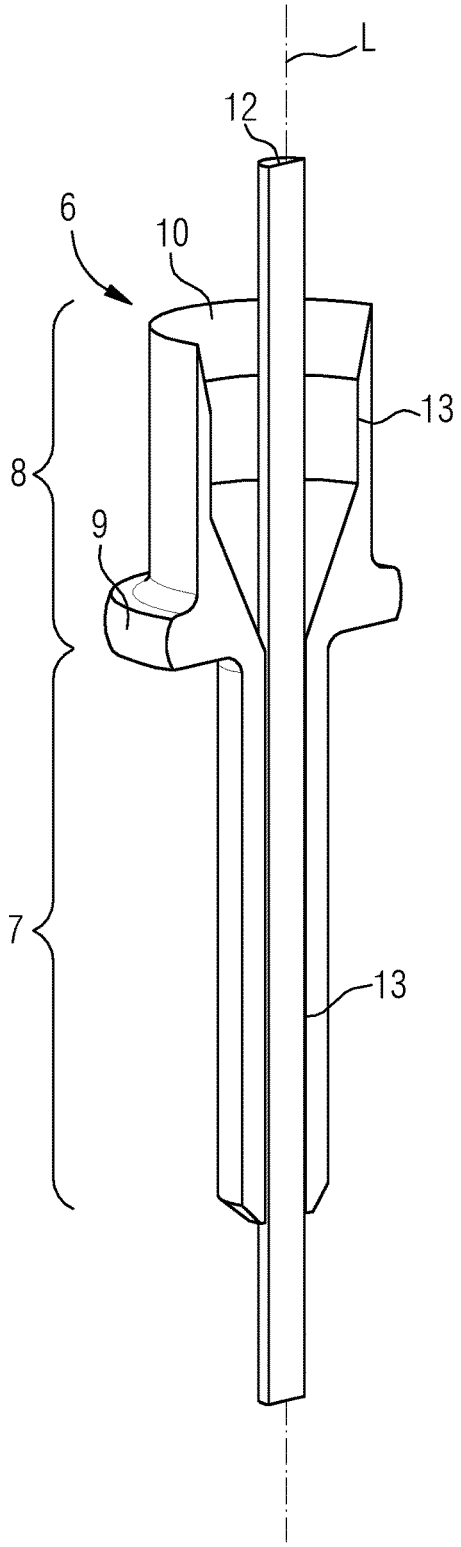
FIG. 2B shows the contact pin according to the first embodiment in a cross-sectional oblique view.

The driver 3 is connected to the two contact pins 6 via respective electrically conductive connection elements in form of contact wires 12 which are introduced into cavities 13 of the contact pins 6. FIG. 2A shows the contact pin 6 with the contact wire 12 inserted therein in an oblique view. FIG. 2B shows the contact pin 6 with the contact wire 12 inserted therein in a cross-sectional oblique view.

The cavity 13 extends along a longitudinal direction or a longitudinal axis L of the contact pin 6 and is formed in a circular cylindrical form in the region of the contact portion 7. In the widened portion 8 the cavity 13 is widening inwards like a funnel which facilitates inserting the contact wire 12. Extending from the contact portion 7, the cavity 13 is in particular widening initially conically, next cylindrically and then like a truncated cone at the edge 10. An outside or an outer contour of the widened portion 8 is cylindrical after the flange 9. The widened portion 8 can in particular be riveted by reshaping its section or edge 10 in the form of a truncated cone.

The contact wire 12 can be inserted by introducing the driver 3 into the housing 2 after riveting of the contact pins 6 and thereby plugging the contact pins 12 into the cavities 13 from the inside. In this embodiment the contact wire 12 is plugged through the cavity 13 and its free end portion protrudes rearwards beyond the contact pin 6.

For fastening the contact wire 12 in the related contact pin 6, the contact wire 12 can, for example, be soldered to or welded with the contact pin 6. Alternatively or additionally, the contact portion 7 can be crimped to hold the contact wire 12 in a clamping or press fit.

Figure 3:
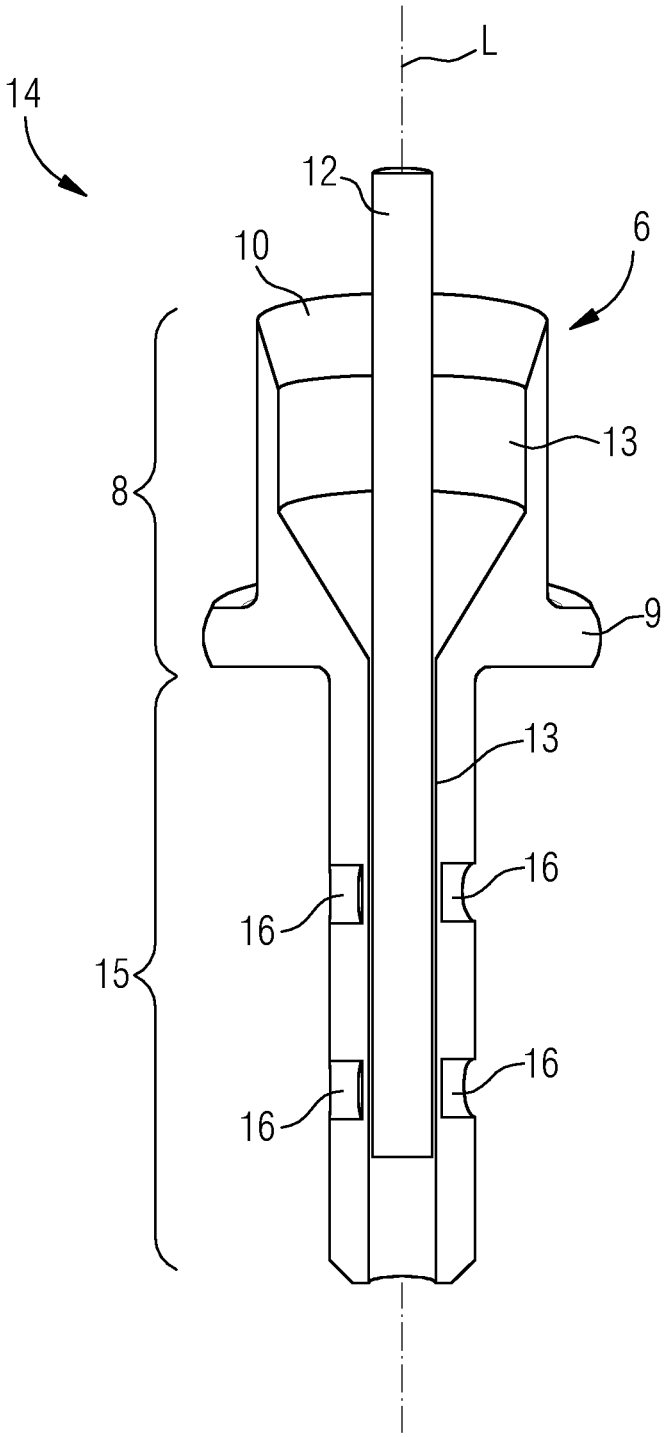
FIG. 3 shows a contact pin of the retrofit lamp according to the invention according to a second embodiment in a cross-sectional oblique view.
Figure 4A:
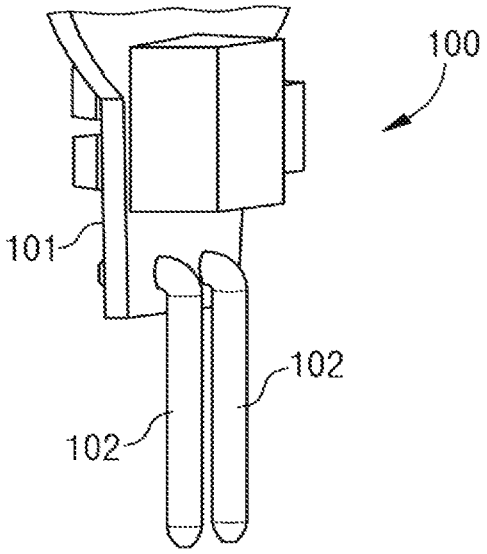
Fig. 4A Prior Art
FIG. 4A shows a section of a driver of a conventional LED MR16 retrofit lamp with two contact pins in an oblique view.
Figure 4B:
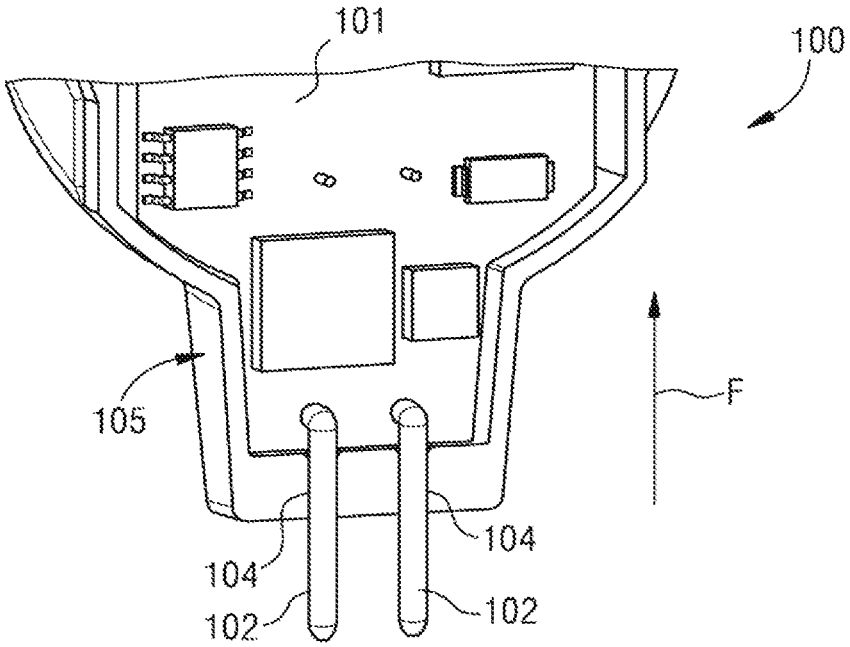
Fig. 4B Prior Art
FIG. 4B shows a section of the conventional LED MR16 retrofit lamp with inserted driver in a cross-sectional oblique view.

FIG. 3 shows a contact pin 14 in cross-sectional oblique view which can also be used with the retrofit lamp 1. The contact pin 14 is formed similar to the contact pin 6, but laterally, in particular vertically, comprises holes 16 in its contact portion 15 leading to the cavity 13. These holes can for example facilitate soldering the contact wire 12 or crimping the contact portion 15.

Here, the contact wire 12 ends in the cavity 13 and does therefore not protrude rearwards beyond the cavity.

Although the invention was illustrated and described in detail by the shown embodiments, the invention is not limited thereto, and other variations can be derived therefrom by those skilled in the art without leaving the scope of the invention.

Generally, "a", "an" etc. may be understood as singular or plural, in particular in terms of "at least one" or "one or more" etc., as long as this is not excluded explicitly, e.g. by the term "exactly one" etc.

Numerical data may also include the given number exactly as well as a usual tolerance range as long as this is not excluded explicitly.

REFERENCE NUMERALS retrofit lamp 1
housing 2
driver 3
end face 4
feedthrough 5
contact pin 6
contact portion of the contact pin 7
widened portion of the contact pin 8
flange 9
edge 10
inside portion of the feedthrough 11
contact wire 12
cavity of the contact pin 13
contact pin 14
contact portion 15
hole 16
conventional LED MR16 retrofit lamp 100
driver 101
conventional MR16 contact pin 102
housing 103
feedthrough 104
housing 105
longitudinal axis of the contact pin L
insertion force F

The invention claimed is:

1. A semiconductor lamp, comprising
a housing in which a driver is accommodated, and
at least one contact pin protruding from the housing outwards, wherein
the contact pin is a tubular contact pin riveted to the housing,
the driver is connected to the contact pin via an electrically conductive connection element which is inserted into a cavity of the contact pin,
the housing has a respective feedthrough provided for each contact pin and the feedthrough is widened at an inside portion, and
a space between the widened portion of the feedthrough and the contact pin is at least partially filled with a reshaped material of the contact pin.

2. The semiconductor lamp according to claim 1, wherein the contact pin comprises a laterally protruding flange which rests on the outside of the housing.

3. The semiconductor lamp according to claim 1, wherein the cavity of the contact pin is formed like a funnel at a side facing the driver.

4. The semiconductor lamp according to claim 1, wherein the electrically conductive connection element is a contact wire.

5. The semiconductor lamp according to claim 1, wherein the electrically conductive connection element is fastened on the contact pin.

6. The semiconductor lamp according to claim 1, wherein the contact pin comprises at least one hole laterally leading to the cavity at a portion of the contact pin arranged outside the housing.

7. The semiconductor lamp according to claim 1, wherein the semiconductor lamp has a bipin base.

8. The semiconductor lamp according to claim 7, wherein the semiconductor lamp is a MR16 replacement lamp.

9. The semiconductor lamp according to claim 1, wherein the cavity of the contact pin is closed at an outer side facing away from the driver.

10. A method for producing a semiconductor lamp according to claim 1, comprising the steps of:

inserting at least one tubular contact pin into a feedthrough of a housing from the outside till the contact pin abuts the housing, riveting the contact pin with the housing on the inside, and inserting a driver into the housing, whereby an electrically conductive connection element is inserted into the contact pin, wherein the housing has a respective feedthrough provided for each contact pin and the feedthrough is widened at an inside portion, and wherein a space between the widened portion of the feedthrough and the contact pin is at least partially filled with a reshaped material of the contact pin after the riveting.

11. The method according to claim 10, further comprising fastening the connection element inserted into the contact pin to the contact pin.

12. A semiconductor lamp, comprising a housing in which a driver is accommodated, and at least one contact pin protruding from the housing outwards, wherein the contact pin is a tubular contact pin riveted to the housing, the driver is connected to the contact pin via an electrically conductive connection element which is inserted into a cavity of the contact pin, and the contact pin comprises at least one continuous hole laterally leading to the cavity at a portion of the contact pin arranged outside the housing.

* * * * *